US008495766B2

(12) United States Patent
Carraro

(10) Patent No.: US 8,495,766 B2
(45) Date of Patent: Jul. 30, 2013

(54) ENGINEERED TEXTILE YARN

(75) Inventor: Rinaldo Carraro, Paruzzaro (IT)

(73) Assignee: Carraro S.r.l., Paruzzaro (NO) (IT)

( * ) Notice: Subject to any disclaimer, the term of this patent is extended or adjusted under 35 U.S.C. 154(b) by 356 days.

(21) Appl. No.: 12/532,235

(22) PCT Filed: Mar. 22, 2007

(86) PCT No.: PCT/IT2007/000212

§ 371 (c)(1),
(2), (4) Date: Dec. 17, 2009

(87) PCT Pub. No.: WO2008/114296

PCT Pub. Date: Sep. 25, 2008

(65) Prior Publication Data

US 2010/0101007 A1 Apr. 29, 2010

(51) Int. Cl.
*G21F 3/02* (2006.01)

(52) U.S. Cl.
USPC ..... 2/456; 2/69; 2/79; 2/905; 2/902; 57/221; 57/901

(58) Field of Classification Search
USPC ..... 2/456, 69, 79, 905, 902; 57/221, 57/901
See application file for complete search history.

(56) References Cited

U.S. PATENT DOCUMENTS

| | | | | |
|---|---|---|---|---|
| 3,164,840 | A * | 1/1965 | Reynolds | 2/457 |
| 3,877,965 | A * | 4/1975 | Broadbent et al. | 427/304 |
| 5,287,690 | A | 2/1994 | Toon | |
| 5,305,593 | A | 4/1994 | Rodini et al. | |
| 5,617,713 | A | 4/1997 | Mawick et al. | |
| 5,968,854 | A | 10/1999 | Akopian et al. | |
| 2008/0134407 | A1 * | 6/2008 | Winterhalter et al. | 2/79 |

FOREIGN PATENT DOCUMENTS

| | | |
|---|---|---|
| EP | 0290977 A1 | 11/1988 |
| EP | 0564331 A1 | 10/1993 |

* cited by examiner

*Primary Examiner* — Alissa Tompkins
(74) *Attorney, Agent, or Firm* — Rothwell, Figg, Ernst & Manbeck PC

(57) ABSTRACT

The present invention relates to an electrically conductive textile yarn for production of protective garments, comprising a first element which is made electrically conductive by means of a layer of silver, and a second element which is different from the said first element, and is provided with good resistance to fire; the first element can be in the form of filaments or fibers. The present invention also relates to a garment produced by means of a yarn of this type and to a method for production of the yarn itself.

5 Claims, 3 Drawing Sheets

ENGINEERED TEXTILE YARN

CROSS REFERENCE TO RELATED APPLICATION(S)

This application is a 35 U.S.C. §371 National Phase Entry Application from PCT/IT2007/000212, filed Mar. 22, 2007, and designating the United States. The disclosure of which is incorporated herein in its entirety by reference.

The present invention relates to an electrically conductive textile yarn, and to a method for production of this yarn.

Yarns of this type are known for example for the production of protective garments for engineers who carry out maintenance on uncovered high-voltage cables.

These garments must withstand without damage both the mechanical stresses of the cable maintenance operations and attacks by chemicals of the washing cycles, and simultaneously they must also shield the workers against any short-circuit discharges which may be generated between two distinct phases, with differences of potential which, in some states, can reach 800 kV for AC and 600 kV for DC voltages.

Although the known yarns can have shielding properties, in the prior art no yarn is yet known which combines a high level of electrical conductivity with the resilience and flexibility necessary for the production of protective garments for operations on uncovered high-voltage cables, which garments are also comfortable to wear.

The garments known hitherto in the prior art are made of steel wire braided with cotton thread; however these garments have a number of disadvantages: their electrical resistance, measured between any two points, is relatively high; they must be 'activated' before each use by means of a strong electrical discharge so as to restore their original electrical conductivity; and finally, because of its rigidity, the steel wire gives rise to rigid and uncomfortable garments which hamper the movements of the operators.

It is therefore evident that it is necessary to increase the safety margins with which the operators are required to work, thus eliminating at least partially the above-described disadvantages.

In view of the state of the art described, the object of the present invention is to obtain a yarn which makes it possible to produce a protective garment for operations on uncovered high voltage cables, which yarn has a high level of electrical conductivity and is also comfortable to use, so as to eliminate at least partially the above-described disadvantages.

According to the present invention this object is achieved by means of a yarn as claimed herein.

The features and advantages of the present invention will become apparent from the following detailed description of a practical embodiment, given as a non-limiting example with reference to the attached drawings, in which.

In the present description, the term 'fibre' should be understood as indicating a strand with a reduced length, for example a cut piece of wool or cotton; the term 'thread' indicates a plurality of spun fibres twisted together; 'filament' on the other hand indicates a continuous strand with a length which is substantially greater than that of the cut woollen fibres; 'twisted yarn' means the product obtained by twisting together one or more filaments and/or fibres; and 'textile yarn for garments' means a yarn which is suitable for the production of garments.

Figure 1:
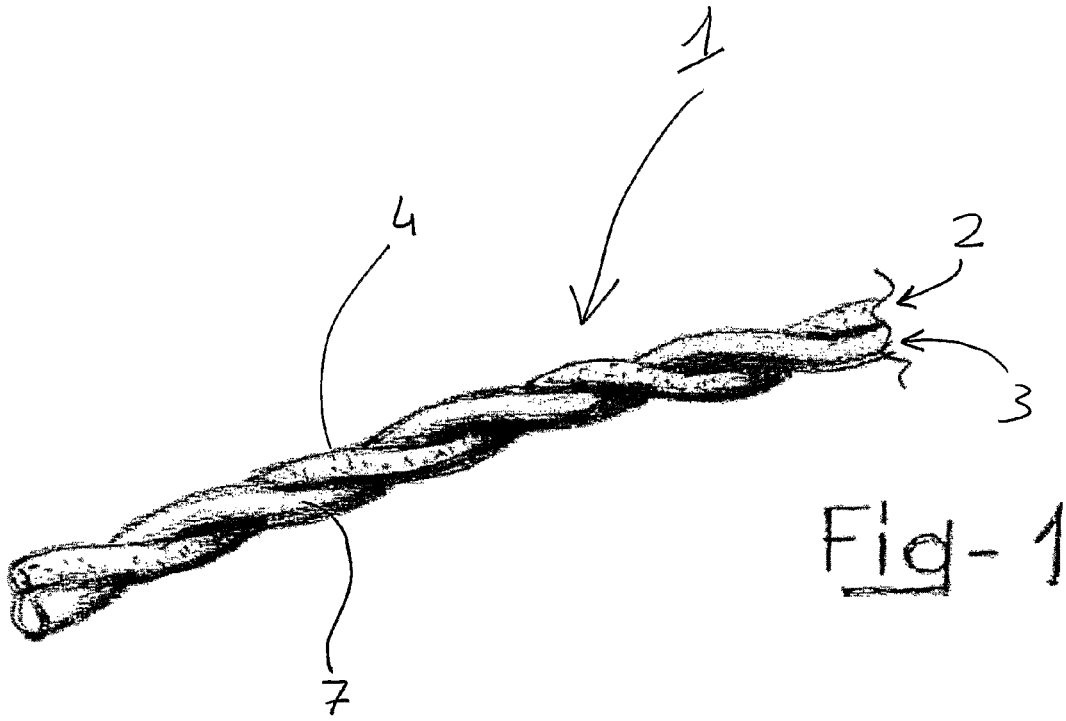
FIG. 1 shows a yarn according to a first embodiment of the present invention.
Figure 2:
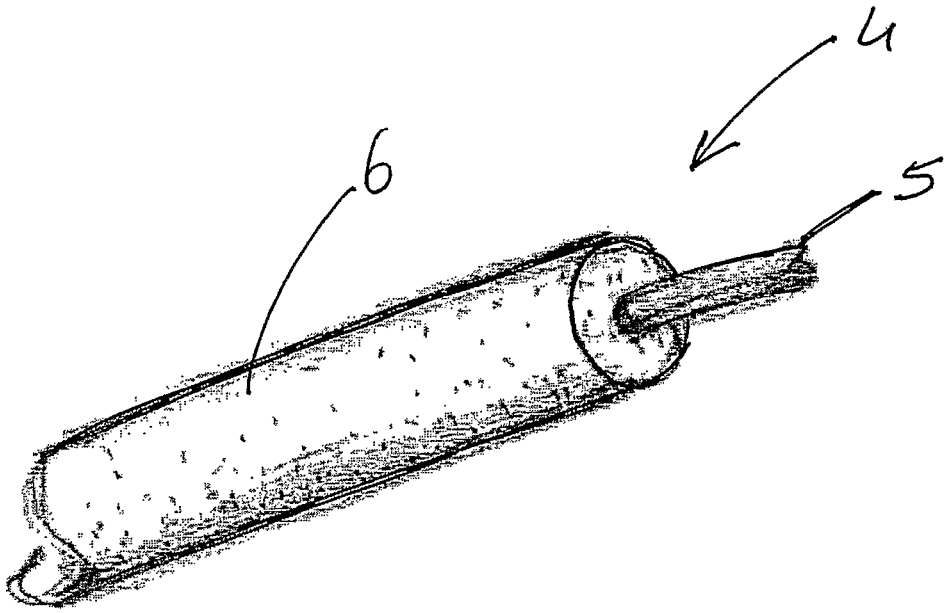
FIG. 2 shows one of the elements which constitute the present invention.
Figure 3:
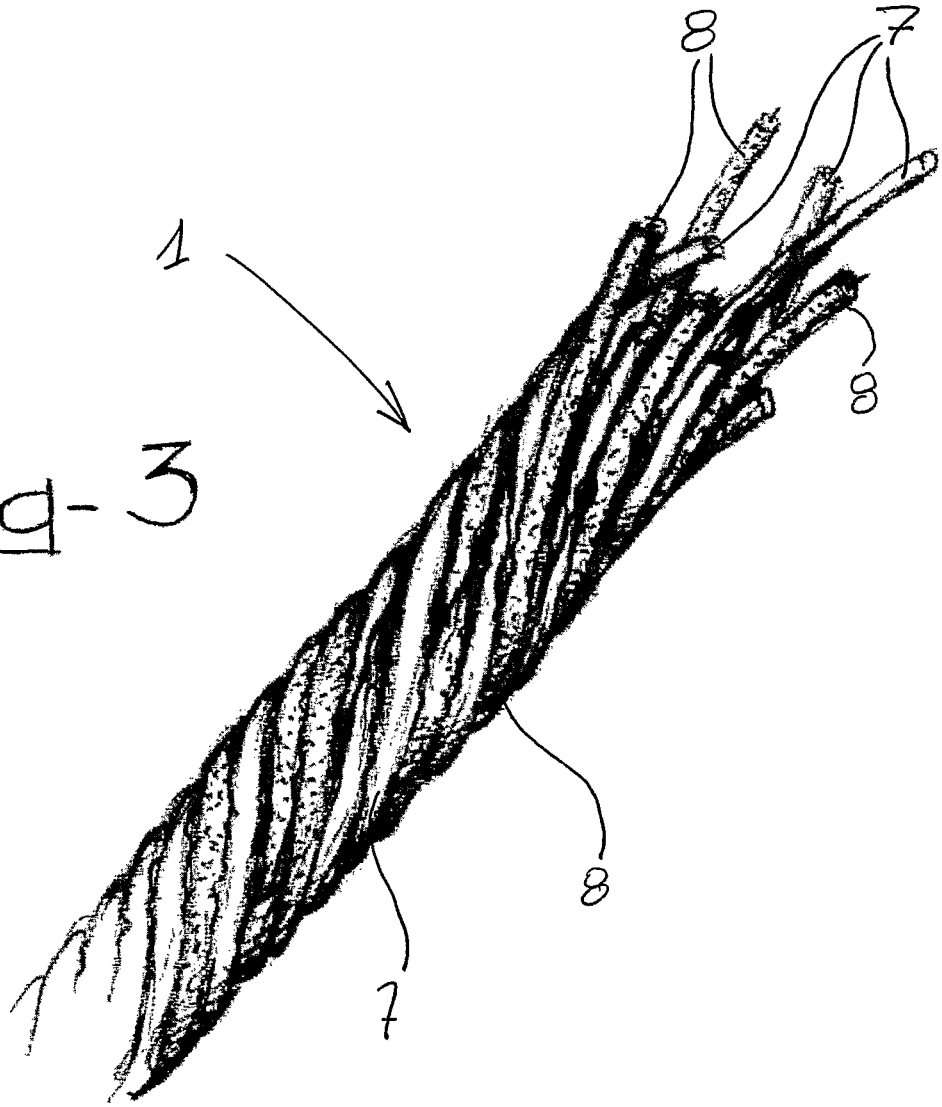
FIG. 3 shows a yarn according to a second embodiment of the present invention.

As can be seen in FIG. 1 or FIG. 3, the conductive textile yarn 1 for garments according to the present invention comprises a first element 2 which is electrically conductive and a second element 3, distinct from the first element 2, which is provided with good resistance to fire.

In general the second element 3 is not conductive, or its conductivity is negligible in comparison with that of the first element 2.

'Good resistance to fire' is understood to mean that the second element 3 has flameproof and/or flame-retardant properties that can be taken advantage of in the textile field of clothing. In this sense, this term can be understood to exclude both mineral fibres, which cannot be woven except with great difficulty, and metallic fibres which, although resistant to extremely high temperatures, are not suitable for garments for high temperatures inasmuch as they are good conductors of heat.

Advantageously, the second element 3 can also be resistant to attacks by chemicals, in order to allow the yarn to withstand repeated washing cycles without being damaged.

According to a preferred embodiment, the first element 2 is a conductive filament 4, preferably comprising a core 5 covered with a layer 6 of conductive metal; advantageously, the core 5 is made of nylon, and the layer 6 of conductive metal is for example made of silver.

The weight of the core 5 is negligible compared with that of the filament 4: in fact, its cross-section can be less than 10%, and for example less than 3%, of the overall cross-section of the filament 4.

The second element 3 comprises a thread 7, which is advantageously obtained from fibres selected from the group comprising aramide fibres, flame-retardant fibres, flame-retardant viscose, flame-retardant cotton, and Lenzing FR®.

Since the yarn 1 according to the present invention advantageously also has flameproof or flame-retardant properties and a high level of chemical resistance to solvents, according to a preferred embodiment the thread 7 is made of polyaramide, and preferably meta-polyaramide, such as Nomex®, for example.

The yarn 1 can also be produced by twisting one or more electrically conductive filaments 4 together with one or more threads 7.

Advantageously, the resulting yarn 1 comprises a single filament 4 and a single thread 7, but it is also possible to produce yarns 1 comprising two, three or more filaments 4, and/or two, three or more threads 7, depending on the original yarn counts and that required for the final yarn.

Advantageously, the fraction of weight of the electrically conductive filament 4 compared with the weight of the yarn 1 according to the present implementation method is between 5% and 50%, and preferably between 30% and 40%, for example approximately 35%.

A particularly advantageous embodiment is that obtained by twisting a silver filament 4 with a yarn count of Nm $1/100000$ together with a meta-aramide polymer thread 7 with a yarn count of Nm $1/55000$, in order to obtain a yarn 1 with a yarn count of Nm $1/30000$ (i.e. comprising approximately 35% Ag by weight and approximately 65% meta-aramide).

This embodiment makes it possible to combine the desired properties in a single yarn 1; the yarn 1 can then be used to obtain garments which are provided with both a high level of electrical conductivity and the other desired properties.

This embodiment requires dual processing, since, in order to obtain the yarn 1, it is necessary to twist together a filament 4 and a thread 7 in order to obtain a twisted yarn, before being able to begin to produce any garment.

These disadvantages can be overcome by means of the second preferred embodiment represented in FIG. 3.

In this embodiment, the first element 2 of the fibre 1 comprises one or more electrically conductive fibres 8, whereas the second element 3 comprises one or more fibres 7, similar to the fibres 7 of the first implementation method.

This implementation method makes it possible to obtain a yarn 1 consisting both of conductive fibres and fibres which have good resistance to fire, so as to increase the homogeneousness of the properties of the yarn 1 itself. Advantageously the yarn 1 thus produced is twisted.

The yarn 1 according to the present implementation method can be produced by mixing together one or more flocks consisting of fibres 7 with one or more flocks consisting of electrically conductive fibres 8.

Advantageously, the fraction by weight of the electrically conductive fibres 8 compared with the weight of the yarn 1 according to the present implementation method is between 5% and 50%, and preferably between 20% and 40%, for example approximately 20% or 30-35%.

Once the yarn 1 has been obtained, it can be used for normal textile production, including fabrics, knitwear and non-woven fabrics.

It will then be possible to produce garments, such as work clothes, overalls, gloves, footwear, etc.

Obviously the person skilled in the art, for the purpose of satisfying contingent and specific needs, will be able to make numerous modifications and variations to the above-described configurations. For example, the second elements 3 can be provided with anti-static properties, anti-bacterial properties, properties of resistance to temperatures higher than 200° C. and/or with particular resistance to acids or strong bases, either by means of treatment before production of the element itself, or by means of subsequent treatment.

Similarly, the core 5 of the filament 4 can in turn be a continuous strand or a thread, and/or it can be produced from a material different from nylon.

Furthermore, all these variants are contained within the scope of protection of the invention as defined by the following claims.

The invention claimed is:

1. An electrically conductive textile yarn for the production of protective garments for conducting maintenance on live high-voltage wires, wherein the said yarn comprises:

a first element comprising one or more electrically conductive threads, each of the electrically conductive threads comprising a core composed of polyamide covered with a layer of silver; and a second element, which is different from the said first element, and comprises one or more threads provided with good resistance to fire, the second element not comprising metallic or mineral fibres;

the yarn being produced by twisting together one or more threads of the second element with one or more electrically conductive threads of the first element;

wherein the fraction by weight of the electrically conductive threads of the first element compared with the weight of said yarn is approximately 30%-35%.

2. The electrically conductive textile yarn according to claim 1, wherein the said second element consists substantially of fibres selected from the group comprising: aramide fibres, meta-aramide fibres, and flame-retardant cotton.

3. The electrically conductive textile yarn according to claim 2, wherein the second element also has anti-static properties and/or anti-bacterial properties, and/or properties of resistance to acids or bases and/or of resistance to temperatures higher than 200° C.

4. The electrically conductive textile yarn according to claim 1, wherein the second element also has anti-static properties and/or anti-bacterial properties, and/or properties of resistance to acids or bases and/or of resistance to temperatures higher than 200° C.

5. A garment comprising a layer created by a yarn according to claim 1 wherein a surface area of the said layer is substantially equal to the surface area of the garment.

* * * * *